US008704614B2

(12) United States Patent
Liu et al.

(10) Patent No.: US 8,704,614 B2
(45) Date of Patent: Apr. 22, 2014

(54) CAVITY FILTER HAVING SURGE SUPPRESS MEANS

(75) Inventors: Hsien-Wen Liu, Keelung (TW); Chien-Chih Lee, Keelung (TW); Chin-Hsuan Tsai, Keelung (TW); Shang-Yu Yang, Keelung (TW)

(73) Assignee: Universal Microwave Technology, Inc., Keelung (TW)

( * ) Notice: Subject to any disclaimer, the term of this patent is extended or adjusted under 35 U.S.C. 154(b) by 359 days.

(21) Appl. No.: 13/115,702

(22) Filed: May 25, 2011

(65) Prior Publication Data

US 2012/0299668 A1 Nov. 29, 2012

(51) Int. Cl.

| | |
|---|---|
| ***H01P 1/213*** | (2006.01) |
| ***H01P 1/208*** | (2006.01) |
| ***H01P 1/162*** | (2006.01) |

(52) U.S. Cl.

USPC ..... 333/134; 333/202; 333/211

(58) Field of Classification Search

USPC ..... 333/81 B, 126, 129, 132, 134, 202–212, 333/227

See application file for complete search history.

(56) References Cited

U.S. PATENT DOCUMENTS

| | | | | |
|---|---|---|---|---|
| 7,002,429 | B2 * | 2/2006 | Asao et al. | 333/22 R |
| 7,330,087 | B2 * | 2/2008 | Gorovoy et al. | 333/106 |
| 2009/0058563 | A1 * | 3/2009 | Seo et al. | 333/209 |

* cited by examiner

*Primary Examiner* — Benny Lee
*Assistant Examiner* — Rakesh Patel
(74) *Attorney, Agent, or Firm* — Muncy, Geissler, Olds & Lowe, P.C.

(57) ABSTRACT

A cavity filter includes a base member defining therein a resonant chamber, an antenna port disposed at the center of the resonant chamber, two signal input/output ports respectively disposed at two distal ends of the resonant chamber for signal input/output, a cover member covering the base member, two feedback channels disposed in the base member at two opposite lateral sides relative to the resonant chamber and respectively connected between the signal ports and the antenna port, and wave-absorbing components respectively mounted in the feedback channels for removing surge waves from feedback frequency components in the feedback channels.

2 Claims, 6 Drawing Sheets

CAVITY FILTER HAVING SURGE SUPPRESS MEANS

BACKGROUND OF THE INVENTION

1. Field of the Invention

The present invention relates to electronic signal filter technology and more particularly, to a cavity filter, which has feedback channels defined therein to enhance signal transmission and wave-absorbing components to remove surge waves from feedback frequency components, improving signal quality and enhancing signal transmission performance.

2. Description of the Related Art

Following fast development of communication technology, many advanced wired and wireless signal transmitting and receiving equipment have been created and are widely used in different fields. However, due to limited wireless communication channels, full bandwidth utilization is quite important. For full bandwidth utilization, communication capacity and quality must be well improved. As different frequency channels may be close to one another, channel isolation must be well done to prevent interference and to maintain signal transmission quality. However, it is not easy to remove noises effectively and achieve excellent channel-to-channel isolation.

A regular bandpass cavity filter (or diplexer) allows bi-directional communication of the energy at a particular frequency range over a single channel and attenuates the energy that is out of this particular frequency range. However, a cavity filter cannot completely isolate the stop-band energy, causing instability of a transmission signal at the stop-band frequency. A signal feedback design may be employed to regulate the energy at the stop-band frequency. FIGS. 5 and 6 illustrate a cavity filter (diplexer) according to the prior art. According to this design, the cavity filter (diplexer) A comprises a base member A1 defining therein a resonant chamber A0, an antenna port A2 disposed at the center of the resonant chamber A0, and two signal input/output ports A3 respectively disposed at the two distal ends of the resonant chamber A0. During operation of the cavity filter (diplexer) A, in case two feedback channels A4 are disposed in the base member A1 at two opposite lateral sides relative to the resonant chamber A0, signal feedback in the feedback channels A4 may cause surge waves B to interfere with the signal transmitting/receiving frequency, affecting signal stability.

SUMMARY OF THE INVENTION

The present invention has been accomplished under the circumstances in view. It is one object of the present invention to provide a cavity filter, which has feedback channels defined therein to enhance signal transmission and wave-absorbing components to remove surge waves from feedback frequency components, improving signal quality and enhancing signal transmission performance.

To achieve this and other objects of the present invention, a cavity filter comprises a base member defining therein a resonant chamber, an antenna port disposed at the center of the resonant chamber, two signal input/output ports respectively disposed at two distal ends of the resonant chamber for signal input/output, a cover member covering the base member, two feedback channels disposed in the base member at two opposite lateral sides relative to the resonant chamber and respectively connected between the signal input/output ports and the antenna port, and wave-absorbing components respectively mounted in the feedback channels for removing surge waves from feedback frequency components in the feedback channels.

Further, the wave-absorbing components are carbon enveloped strip members that effectively remove surge waves from feedback frequency components.

DETAILED DESCRIPTION OF THE PREFERRED EMBODIMENT

Figure 1:
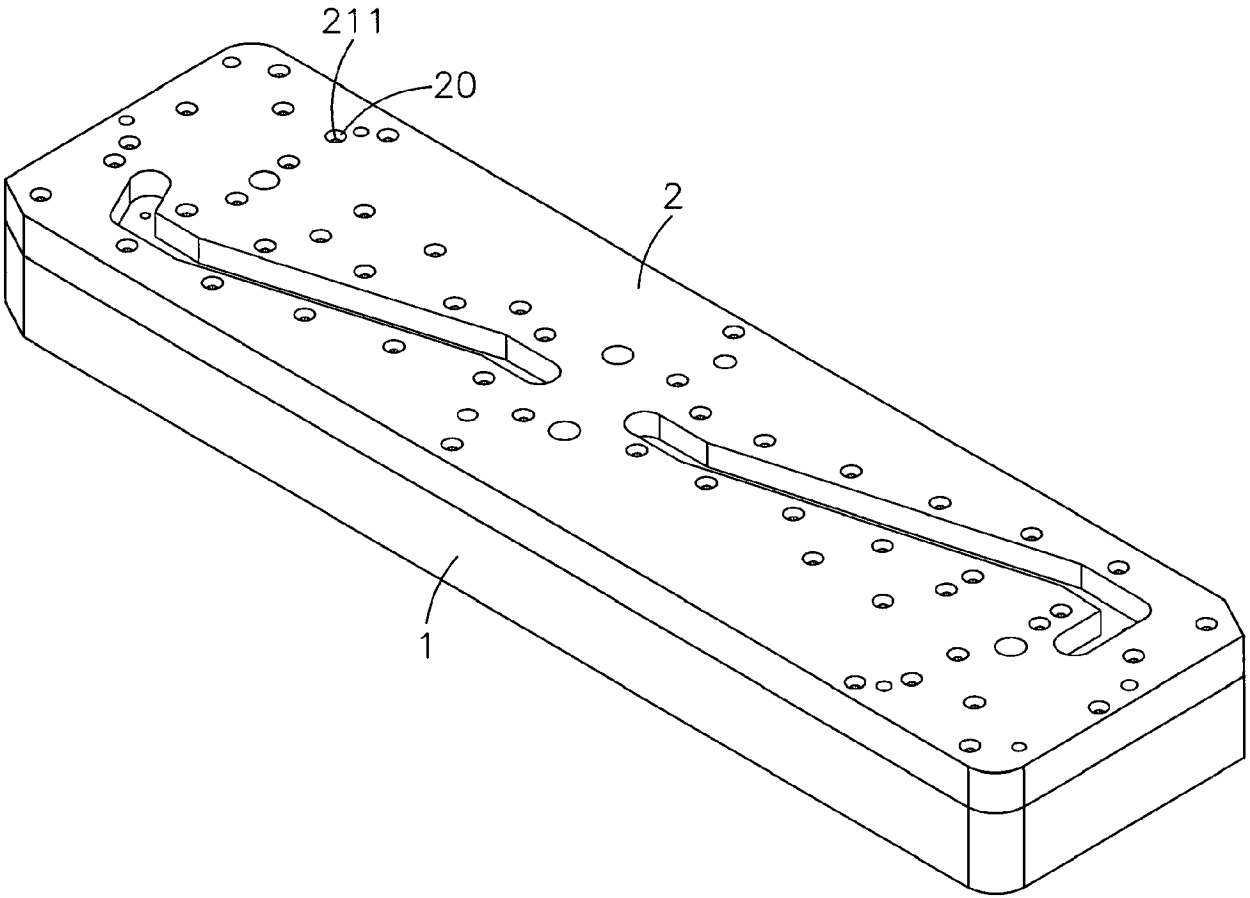
FIG. 1 is an elevation view of a cavity filter in accordance with the present invention.
Figure 2:
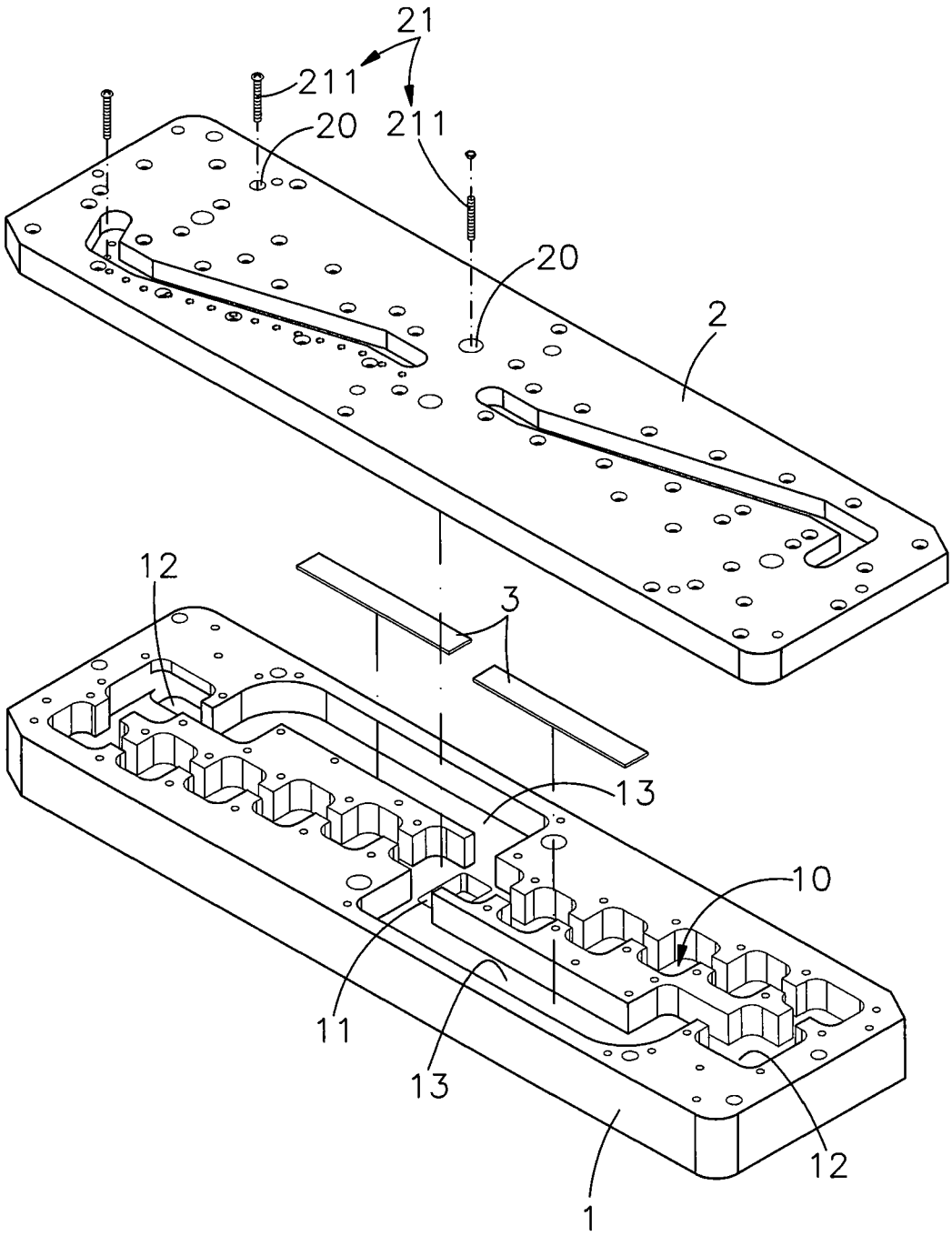
FIG. 2 is an exploded view of the cavity filter in accordance with the present invention.
Figure 3:
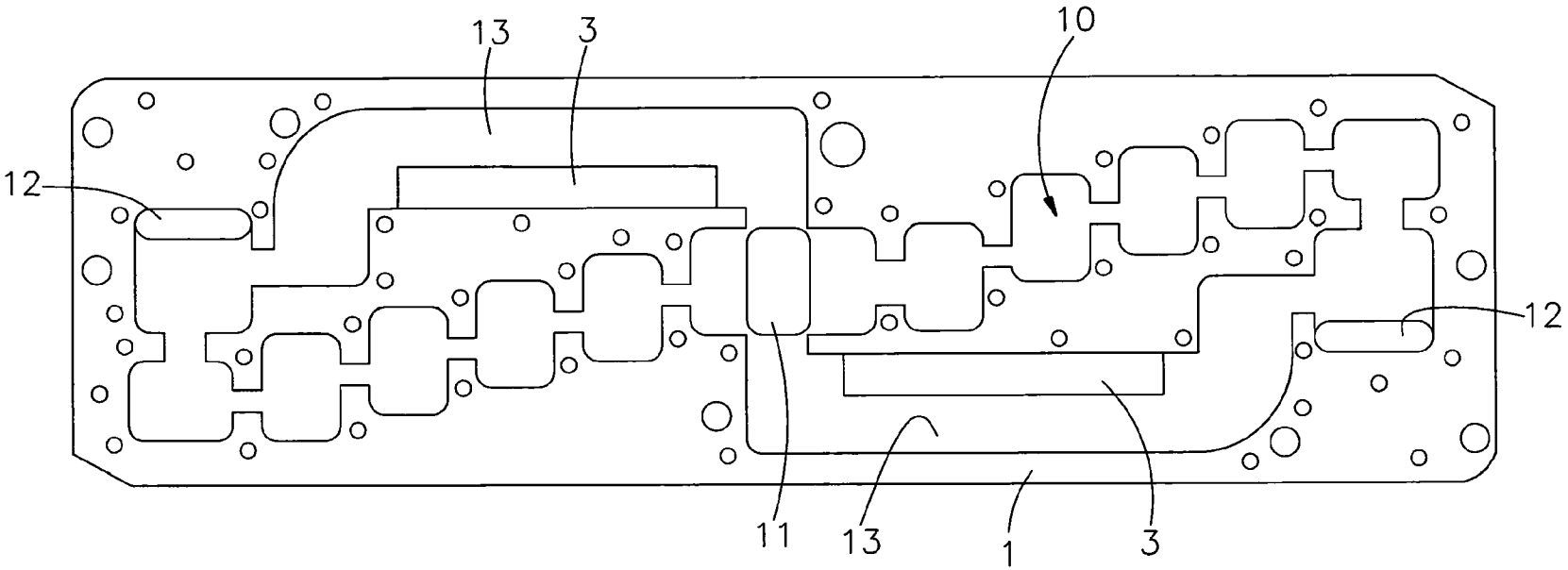
FIG. 3 is a top view of the base member for cavity filter in accordance with the present invention.
Figure 4:
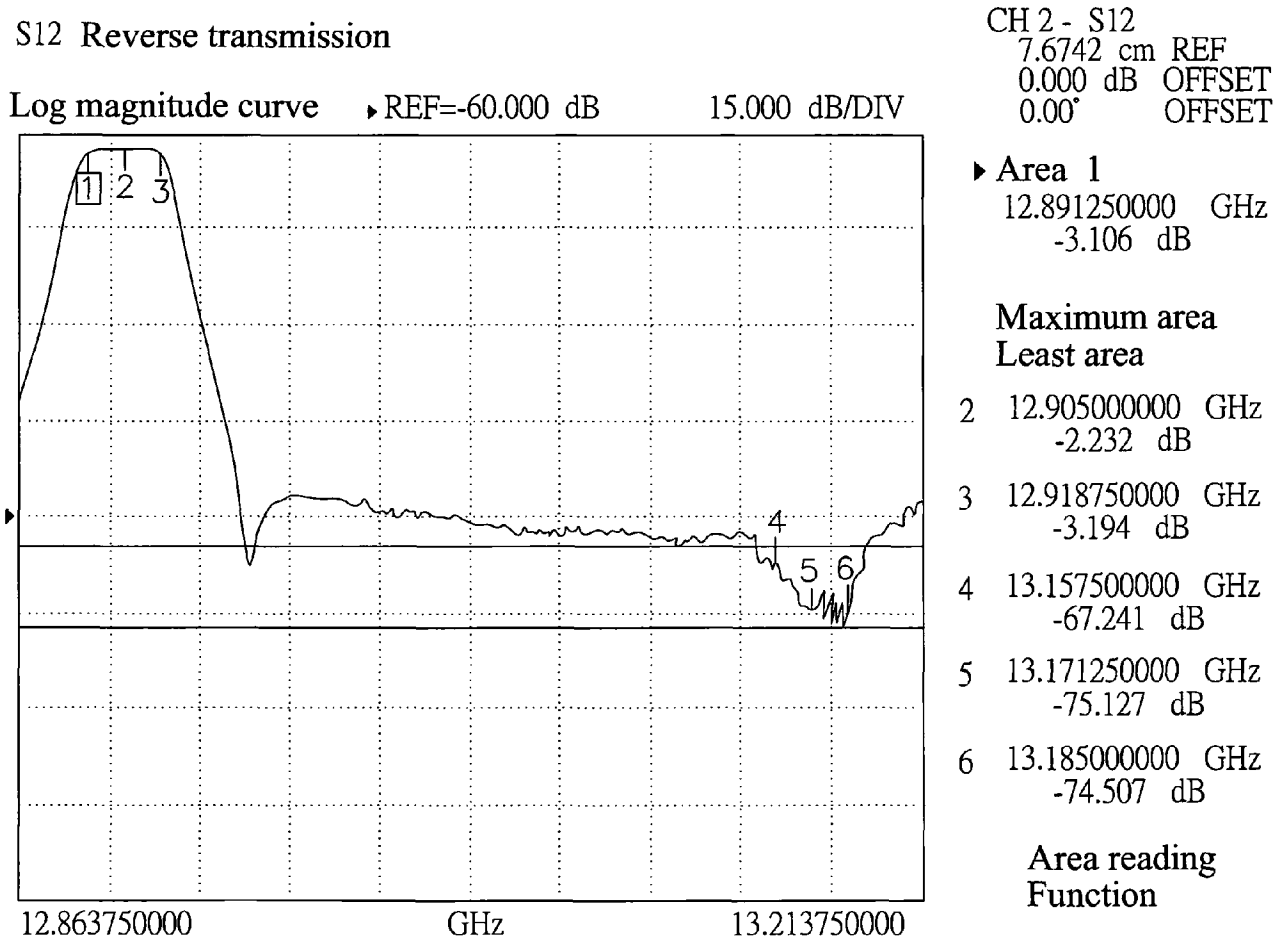
FIG. 4 is a diagram of a filtered signal obtained according to the present invention.
Figure 5:
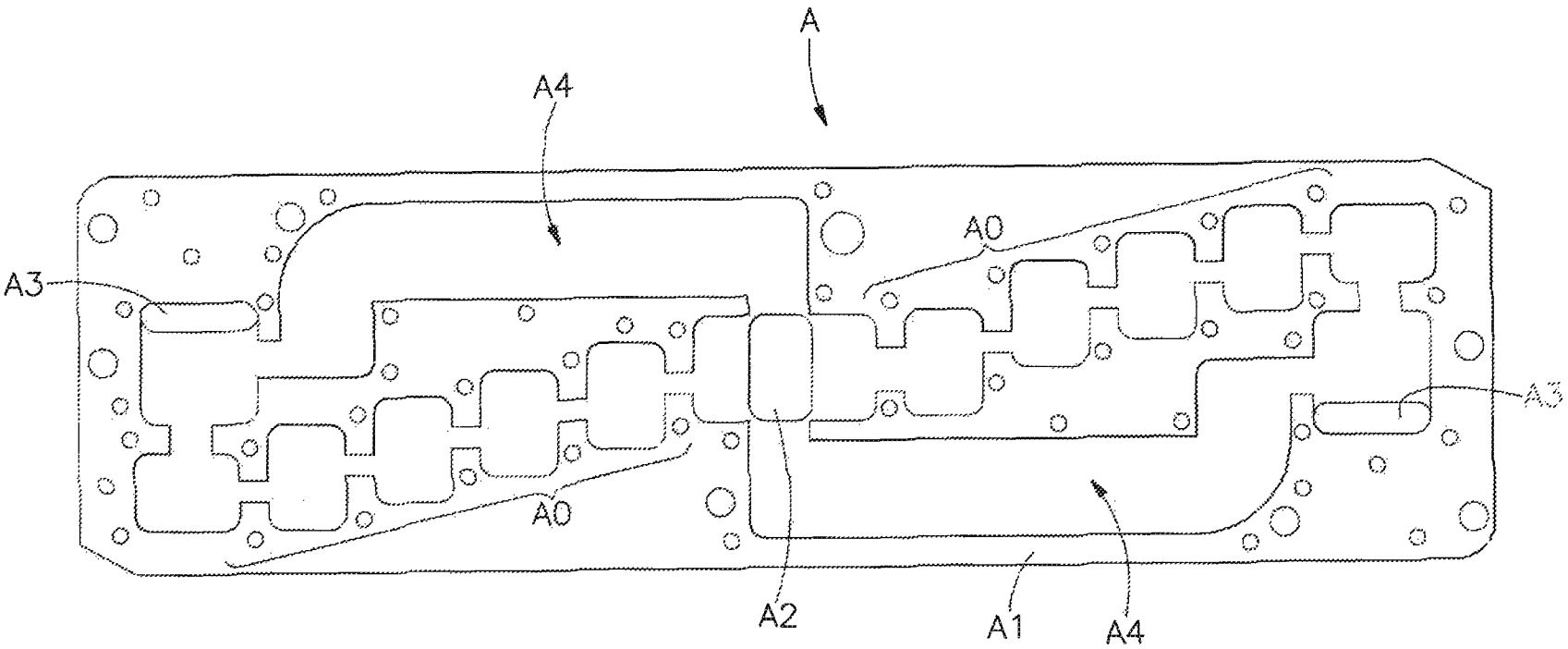
PRIOR ART FIG. 5
FIG. 5 is a top view of a cavity filter according to the prior art.
Figure 6:
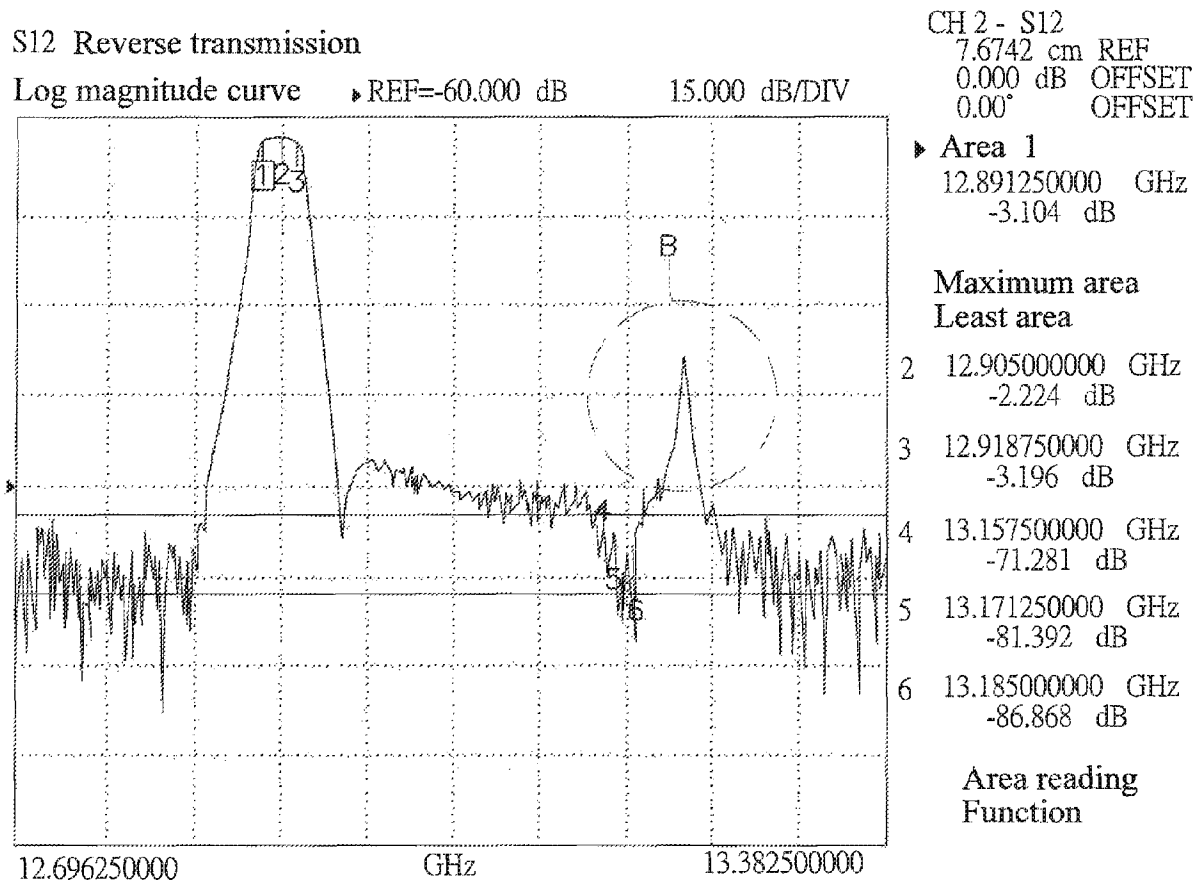
PRIOR ART FIG. 6
FIG. 6 is a diagram of a filtered signal obtained according to the prior art.

Referring to FIGS. 1~4, a cavity filter in accordance with the present invention is shown comprising a base member 1, a cover member 2 and a plurality of wave-absorbing components 3.

The base member 1 comprises a resonant chamber 10 on the middle, an antenna port 11 at the center of the resonant chamber 10, two signal input/output ports 12 respectively disposed at the two distal ends of the resonant chamber 10 for signal input/output, and two feedback channels 13 disposed at two opposite lateral sides relative to the resonant chamber 10 and respectively connected between the signal input/output ports 12 and the antenna port 11.

The cover member 2 is adapted for closing the base member 1, comprising a plurality through holes 20 cut through opposing top and bottom sides thereof for receiving frequency-adjusting rods 211 of a frequency adjustment device 21.

The wave-absorbing components 3 are carbon enveloped strip members.

During installation, the wave-absorbing components 3 are respectively set in the feedback channels 13 of the base member 1, and then the cover member 2 is covered on the base member 1, and then the frequency-adjusting rods 211 of the frequency adjustment device 21 are respectively threaded into the through holes 20 of the cover member 2 and tuned to adjust the frequency and bandwidth of the resonant chamber 10.

During application, signal received (or transmitted) by the antenna port 11 is transmitted into the resonant chamber 10 for fetching frequency components within a predetermined range. At this time, the frequency-adjusting rods 211 of the frequency adjustment device 21 are respectively tuned to adjust the frequency and bandwidth of the resonant chamber 10 subject to the desired frequency range. After adjustment, the signal is transmitted to the signal input/output ports 12 for enabling the signal input/output ports 12 to receive (or transmit) the predetermined frequency component. The frequency components of the other ranges are attenuated to a low level. The attenuated frequency components are fed back for compensating the component response of the stop-band. The usable feedback frequency components are transmitted into the feedback channels 13 of the base member 1 and processed by the wave-absorbing components 3 in the feedback channels 13 to remove surge waves from the feedback frequency components, avoiding interference of noises and improving the quality of the signal received by the signal receiver (such as wireless communication base station, satellite communication equipment or microwave transmitter/receiver antenna) that is used with the cavity filter.

In conclusion, the invention provides a cavity filter comprising a base member 1, which comprises a resonant chamber 10 on the middle, an antenna port 11 at the center of the resonant chamber 10, two signal input/output ports 12 respectively disposed at the two distal ends of the resonant chamber 10 for signal input/output, and two feedback channels 13 disposed at two opposite lateral sides relative to the resonant chamber 10 and respectively connected between the signal input/output ports 12 and the antenna port 11, wave-absorbing components 3 respectively mounted in the feedback channels 13 for removing surge waves from feedback frequency components, and a cover member 2 covering the base member 1. Subject to the functioning of the wave-absorbing components 3 to remove surge waves from feedback frequency components, the invention avoids interference of noises and improves the quality of the received signal.

In actual practice, the cavity filter of the present invention has the features as described hereinafter:

1. The base member 1 has two feedback channels 13 disposed at two opposite lateral sides relative to the resonant chamber 10 therein and respectively connected between the two opposing signal input/output ports 12 at the two distal ends of the resonant chamber 10 and the antenna port 11 at the center of the resonant chamber 10, and wave-absorbing components 3 respectively mounted in the feedback channels 13 for removing surge waves from feedback frequency components.
2. The arrangement of the two feedback channels 13 at two opposite lateral sides relative to the resonant chamber 10 greatly improves the quality of the signal received by the signal receiver using with the cavity filter, enhancing signal transmission performance.

As stated above, the invention provides a cavity filter that has two feedback channels disposed at two opposite lateral sides of a resonant chamber in a base member thereof and respectively connected between two opposing signal ports at two distal ends of the resonant chamber and a antenna port at the center of the resonant chamber, and wave-absorbing components respectively mounted in the feedback channels for removing surge waves from feedback frequency components. The arrangement of the two feedback channels at two opposite lateral sides relative to the resonant chamber greatly improves the quality of the signal received by the signal receiver using with the cavity filter, enhancing signal transmission performance. Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A cavity filter comprising a base member defining therein a resonant chamber, an antenna port at the center of said resonant chamber, two signal input/output ports respectively disposed at two distal ends of said resonant chamber for signal input/output, and a cover member covering said base member, wherein two feedback channels are disposed in said base member at two opposite lateral sides relative to said resonant chamber and respectively connected between said two signal input/output ports and said antenna port, and a plurality of wave-absorbing components are respectively mounted in said two feedback channels for removing surge waves from feedback frequency components in said two feedback channels, wherein said plurality of wave-absorbing components are carbon enveloped strip members.

2. The cavity filter as claimed in claim 1, wherein said resonant chamber has a symmetric configuration relative to said antenna port.

* * * * *